US005524779A

United States Patent [19]

Faile

[11] Patent Number: 5,524,779

[45] Date of Patent: Jun. 11, 1996

[54] SAFETY CLOSURE WITH LOCKING MEANS AND ATTACHED KEY

[76] Inventor: Curtis E. Faile, 3559 Mining Rd., Kershaw, S.C. 29067

[21] Appl. No.: 343,665

[22] Filed: Nov. 22, 1994

[51] Int. Cl.[6] ..... B65D 55/14

[52] U.S. Cl. ..... 215/207; 215/219; 215/302; 220/284

[58] Field of Search ..... 215/204, 207, 215/213–215, 222, 228, 219, 301–303, 221, 223; 220/210, 284

[56] References Cited

U.S. PATENT DOCUMENTS

| | | | |
|---|---|---|---|
| 738,917 | 9/1903 | Kempien | 215/207 |
| 2,063,678 | 12/1936 | Hulme | 215/215 |
| 2,359,639 | 10/1944 | Hanahan . | |
| 2,864,519 | 12/1958 | Crabbe . | |
| 2,921,705 | 1/1960 | Dorsey . | |
| 3,164,277 | 1/1965 | Reading . | |
| 3,181,718 | 5/1965 | Chancellor | 215/213 |
| 3,276,612 | 10/1966 | Caldwell | 215/215 |
| 3,394,830 | 7/1968 | Schiavo . | |
| 3,396,864 | 8/1968 | Jones et al. . | |
| 3,426,932 | 2/1969 | Rouse | 215/207 |
| 3,485,402 | 12/1969 | Tunstall . | |
| 3,501,041 | 3/1970 | Schaefer . | |
| 3,625,386 | 12/1971 | Schaefer . | |
| 3,684,115 | 8/1972 | Birch . | |
| 3,710,970 | 1/1973 | Elfline | 215/215 |
| 3,843,008 | 10/1974 | Colella . | |
| 4,014,449 | 3/1977 | Hadley et al. . | |
| 4,775,061 | 10/1988 | Coote . | |
| 4,796,768 | 1/1989 | Stuckey | 215/207 |

FOREIGN PATENT DOCUMENTS

| | | | |
|---|---|---|---|
| 2142612 | 1/1985 | United Kingdom | 215/204 |
| 2182648 | 5/1987 | United Kingdom | 215/204 |

*Primary Examiner*—Gary E. Elkins
*Assistant Examiner*—Nathan Newhouse
*Attorney, Agent, or Firm*—W. Thad Adams, III

[57] ABSTRACT

The safety closure includes an outer closure member having cylindrical interior walls, and an inner cylinder. The inner cylinder is nested within the interior walls of the outer closure member, and permits normally free rotation of the outer closure member relative to the inner cylinder. Complementary screw threads connect the inner cylinder to a mouth of the container, and cooperate with the outer closure member to lock the safety closure onto the container. A key is permanently secured to the safety closure for unlocking engagement of the complementary screw threads. The key is manipulated by a user to prevent the normally free rotation of the outer closure member relative to the inner cylinder, thus permitting the safety closure to be removed from the container.

9 Claims, 5 Drawing Sheets

SAFETY CLOSURE WITH LOCKING MEANS AND ATTACHED KEY

TECHNICAL FIELD AND BACKGROUND OF THE INVENTION

This invention relates to a safety closure for a container. The invention is especially applicable to containers, such as prescription medicine bottles and the like, which contain materials potentially dangerous to children and other persons.

Safety screw caps and closures are generally known in the art, and suffer from drawbacks and limitations. According to one prior art safety cap, a separate tool is required to remove the cap from the container. If the tool is misplaced or not readily available to the user, the cap cannot be removed. As a result, in a medical emergency, the contents of the container may not be accessible to a person in desperate need. Moreover, the removable tool is subject to damage and wear, and may eventually become inoperable over a limited period of use.

According to another prior art safety cap, in order to remove the cap from the container, a relatively large amount of downward pressure must be applied to the cap while simultaneously turning the cap. This type of safety cap is generally difficult to remove, particularly for elderly persons, and may delay or wholly prevent access to the contents of the container in an emergency situation.

The present invention addresses these and other problems of many prior art safety closures by providing a closure which cannot be easily removed from a container without proper removal instructions by a person with adequate mental and motor capacity. Relatively little physical strength is required to remove the safety closure of the present invention from the container. In addition, the invention does not utilize a separate, detached tool which can easily be lost or misplaced.

SUMMARY OF THE INVENTION

Therefore, it is an object of the invention to provide a safety closure for a container which cannot be easily removed by children and other persons without removal instructions.

It is another object of the invention to provide a safety closure which is relatively easy to remove in emergency situations by persons with proper removal instructions.

It is another object of the invention to provide a safety closure which requires relatively little physical effort to remove from the container.

It is another object of the invention to provide a safety closure which does not utilize a separate tool for removing the closure from the container.

It is another object of the invention to provide a safety closure which is relatively inexpensive to manufacture.

These and other objects of the present invention are achieved in the preferred embodiments disclosed below by providing a safety closure for a container. The safety closure includes an outer closure member having cylindrical interior walls, and an inner cylinder. The inner cylinder is nested within the interior walls of the outer closure member, and permits normally free rotation of the outer closure member relative to the inner cylinder. Locking means connects the inner cylinder to a mouth of the container, and cooperates with the outer closure member to lock the safety closure onto the container. A key is permanently secured to the safety closure for unlocking the locking means. The key is manipulated by a user to prevent the normally free rotation of the outer closure member relative to the inner cylinder, thus permitting the safety closure to be removed from the container.

According to one preferred embodiment of the invention, the locking means includes an internal screw thread formed with the inner cylinder for engaging a complementary external thread located adjacent to the mouth the container.

According to another preferred embodiment of the invention, the key includes a tab for being inserted into a slot formed in a top wall of the inner cylinder. The safety closure is removed from the container by gripping the outer closure member, manipulating the key to locate the tab into locking engagement with the slot, and then rotating the container to disengage the complementary threads of the inner cylinder and the container.

According to yet another preferred embodiment of the invention, biasing means is located between a top wall of the inner cylinder and a top wall of the outer closure member. The biasing means engages the key to normally urge the tab out of locking engagement with the slot.

According to yet another preferred embodiment of the invention, the key includes an outwardly-extending flange connected thereto for engaging the biasing means.

According to yet another preferred embodiment of the invention, the biasing means is a coil spring.

According to yet another preferred embodiment of the invention, retaining means is located at a bottom end of the outer closure member for holding the inner cylinder and the outer closure member in a nested condition.

According to yet another preferred embodiment of the invention, the retaining means is an annular retaining flange formed at the bottom end of the outer closure member.

According to yet another preferred embodiment of the invention, the outer closure member is an outer cylinder.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
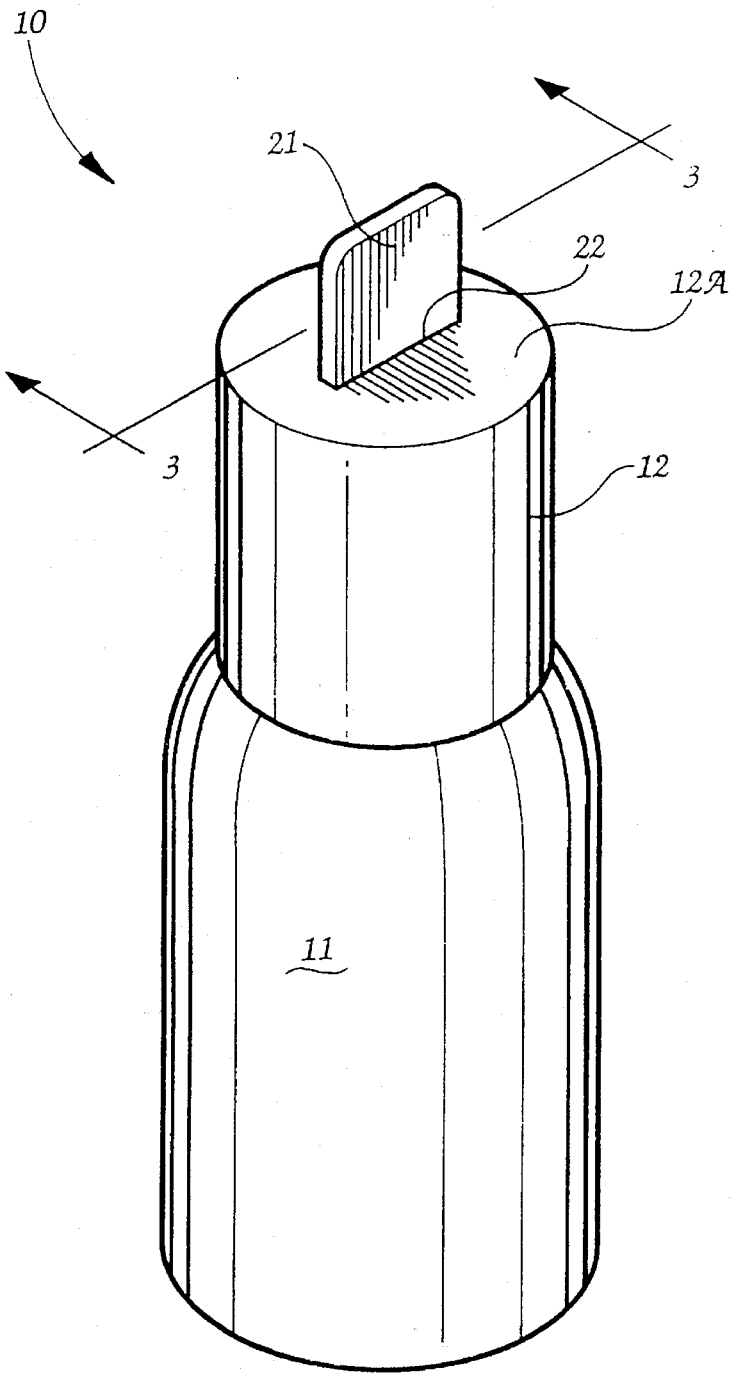
FIG. 1 is a perspective view of the safety closure according to one preferred embodiment of the invention, and showing the safety closure attached to the mouth of a container.

Referring now specifically to the drawings, a safety closure according to the present invention is illustrated in FIG. 1 and shown generally at reference numeral 10. The safety closure 10 is especially applicable to a container 11, such as a prescription medicine bottle, which contains potentially dangerous materials. The safety closure 10 is preferably formed of a material such as polypropylene, polyethylene, polystyrene, or acetal resin.

Figure 2:
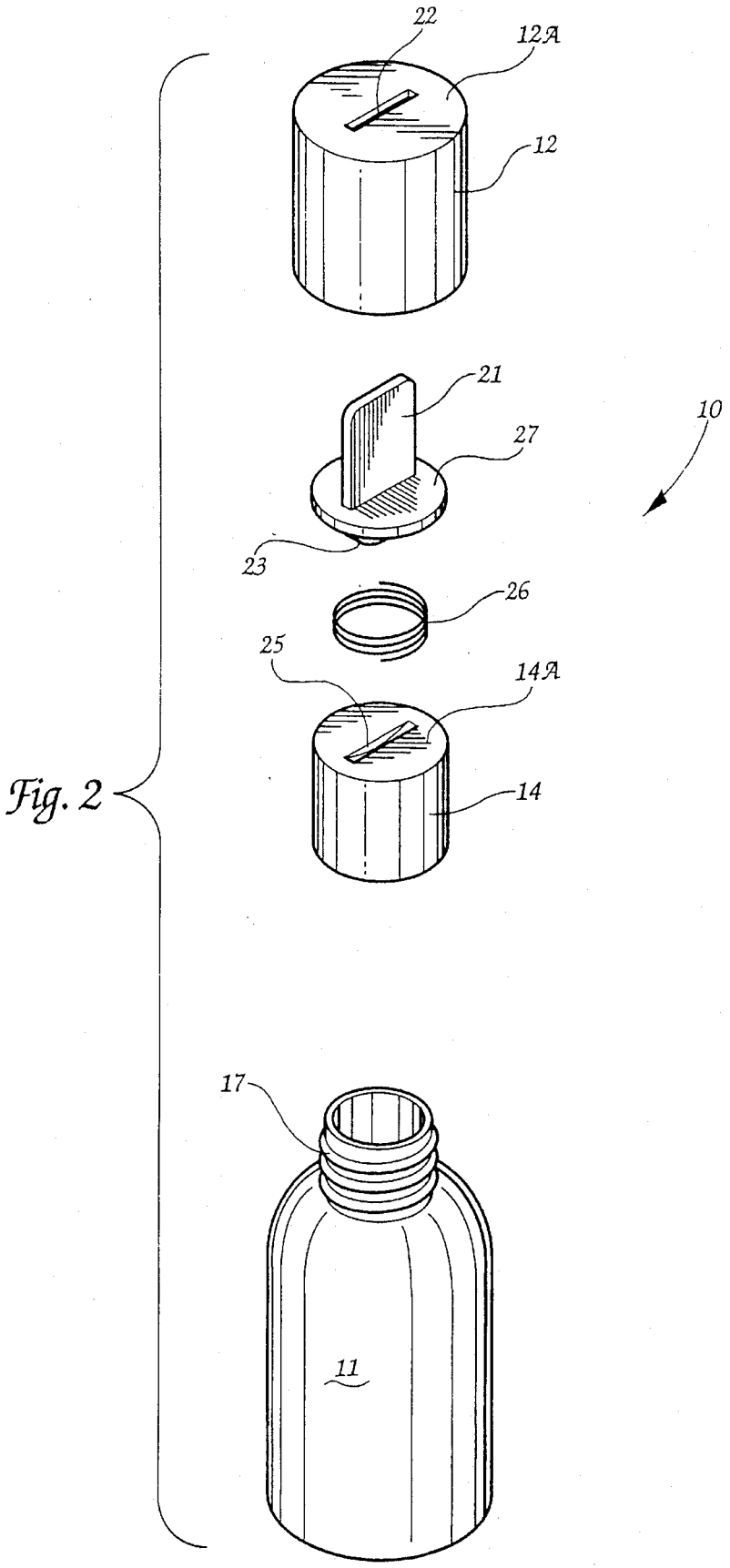
FIG. 2 is an exploded, perspective view of the safety closure showing the interior components of the invention.

As best shown in FIG. 2, the safety closure 10 includes an outer closure member 12 having cylindrical interior walls, and an inner cylinder 14. According to one preferred embodiment, the outer closure member 12 is a cylinder. Alternatively, the outer closure member 12 may have any other geometric exterior shape, such as hexagonal or square, for providing easier gripping.

The inner cylinder 14 has a reduced exterior diameter relative to the interior diameter of the outer closure member 12. The inner cylinder 14 is nested within the interior walls of the outer closure member 12 for free rotation of the outer closure member 12 relative to the inner cylinder 14. An annular retaining flange 15 is preferably formed at a bottom end of the outer closure member 12 for holding the inner cylinder 14 and the outer closure member 12 in a nested condition.

Figure 3A:
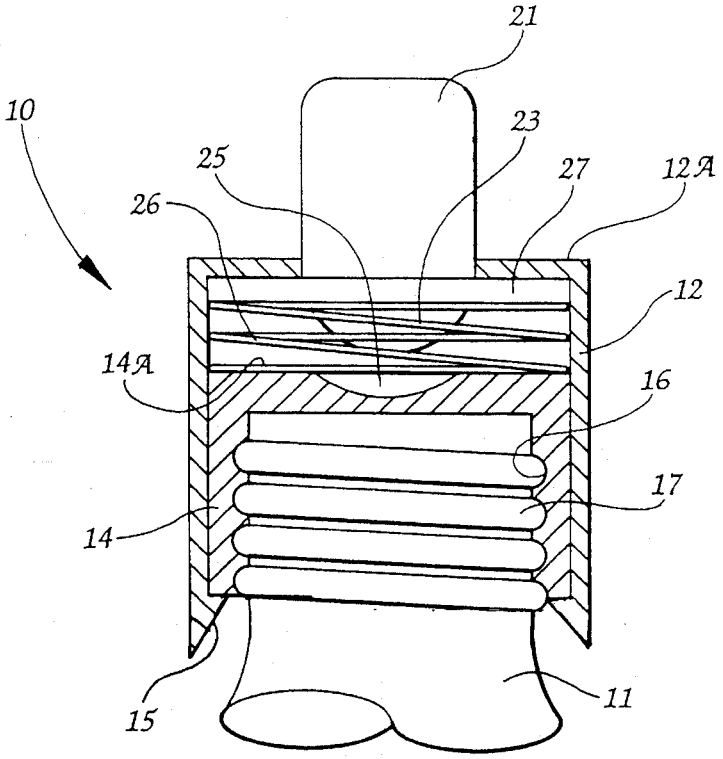
FIG. 3A is a cross-sectional view of the safety closure with the tab of the key in a retracted position out of engagement with a slot formed in the top wall of the inner cylinder.
Figure 3B:
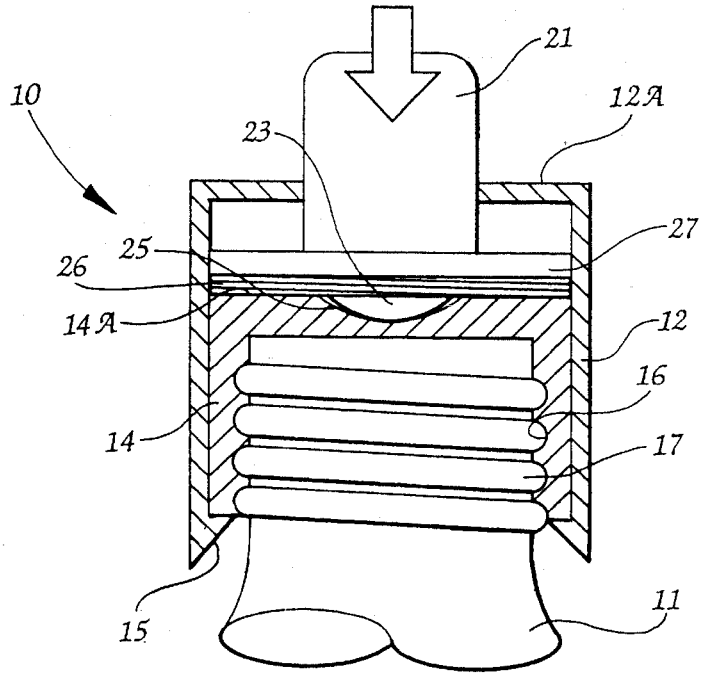
FIG. 3B is a cross-sectional view of the safety closure with the tab of the key in a locking position within the slot formed in the top wall of the inner cylinder.

According to one embodiment of the safety closure 10, the inner cylinder 14 includes an internal screw thread 16 for mating with a complementary screw thread 17 formed adjacent to a mouth of the container 11 (See FIGS. 3A and 3B). Thus, when the safety closure 10 is connected to the mouth of the container 11, the outer closure member 12 will normally rotate about the inner cylinder 14 without effecting movement of the inner cylinder 14. This prevents the safety closure 10 from being removed from the screw thread 17 of the container 11. In an alternative embodiment (not shown), the safety closure is secured to the mouth of the container by means of a bayonet mount, commonly known and used in the art.

A key 21 is permanently mounted in the outer closure member 12, and is used for removing the safety closure 10 from the container 11. The key 21 extends downwardly through an opening 22 formed in a top wall 12A of the outer closure member 12 towards a top wall 14A of the inner cylinder 14. Preferably, the key 21 includes a tab 23 for being downwardly urged into a slot 25 formed in the top wall 14A of the inner cylinder 14. The locking engagement of the tab 23 and slot 25 prevents the normally free rotation of the outer closure member 12 relative to the inner cylinder 14, and allows the user to remove the safety closure 10 from the container 11, as described in detail below.

In an alternative embodiment (not shown), the key includes a flat top surface for being depressed by the thumb of the user. The top surface of the key is preferably smaller than the top wall of the outer closure member. For enhanced appearance, the perimeter shape of the top surface of the key corresponds to the shape of the outer closure member.

A coil spring 26 is located between the top wall 12A of the outer closure member 12 and the top wall 14A of the inner cylinder 14. The spring 26 engages the top wall 14A of the inner cylinder 14 and an outwardly-extending flange 27 of the key 21. As shown in FIG. 3A, the spring 26 operates to normally urge the tab 23 upwardly out of locking engagement with the slot 25. In this position, the outer closure member 12 will rotate freely about the inner cylinder 14, and thereby prevent the safety closure 10 from being unscrewed from the container 11.

Figure 4:
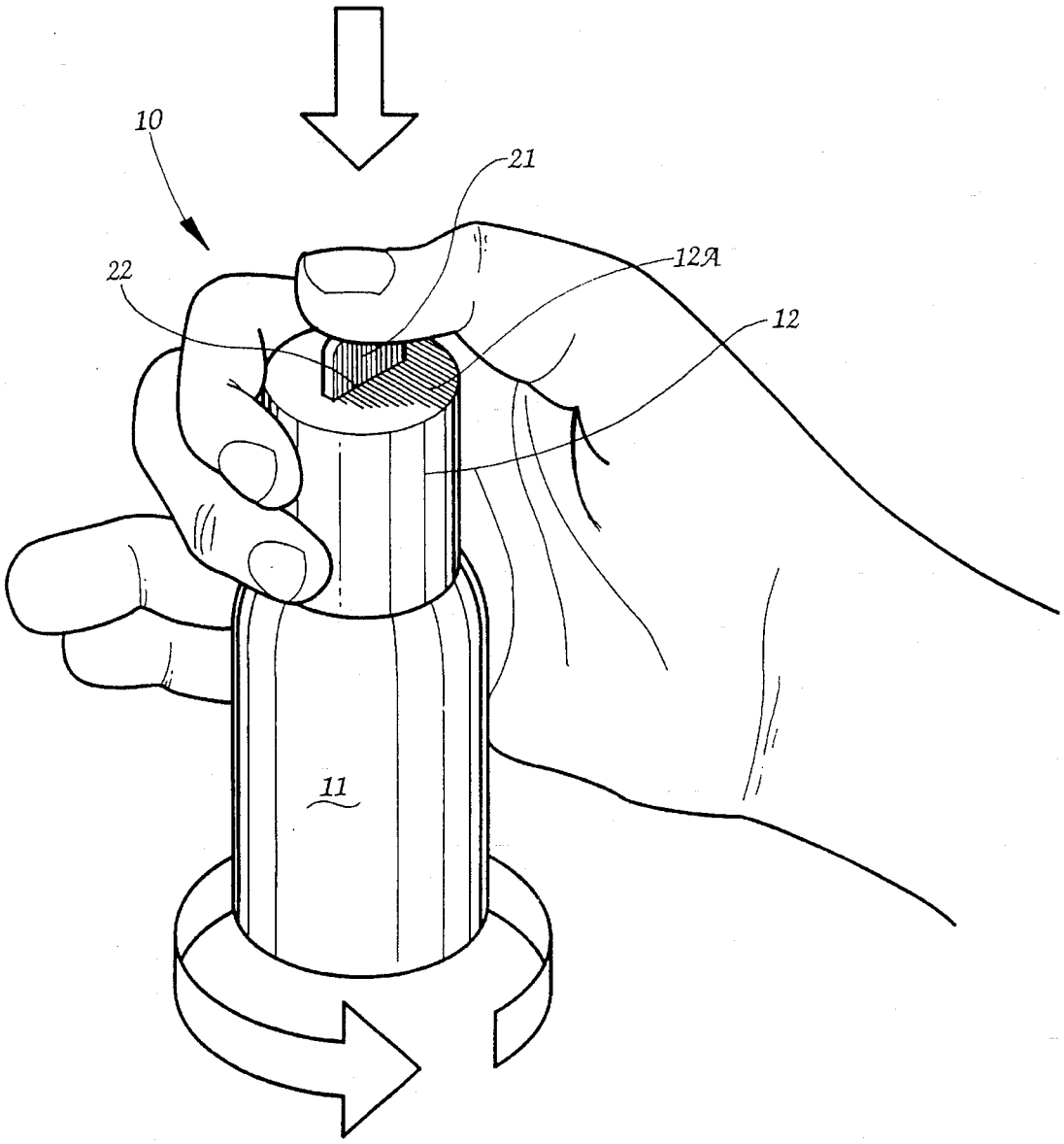
FIG. 4 is a perspective view of the safety closure attached to the container, and demonstrating a method of removing the closure from the container.

Referring to FIGS. 3B and 4, the safety closure 10 is removed from the container 11 by manipulating the key 21 to located the tab 23 into the slot 25. As shown in FIG. 4, the user grips the outer closure member 12 with the forefinger and middle finger of his hand, and depresses the key 21 with the thumb. The outer closure member 12, and thus the key 21, are rotated until the tab 23 moves into registration with the slot 25 in the inner cylinder 14. The downward pressure applied by the user on the key 21 locks the tab 23 into slot 25. Once the tab 23 is locked, the user rotates the container 11 with his other hand to thereby unscrew the safety closure 10 from the container 11.

When in the position shown in FIG. 3B, the outer closure member 12 will not rotate relative to the inner cylinder 14. Instead, both the outer closure member 12 and the inner cylinder 14 are held stationary by the locking engagement of the tab 23 and slot 25, while rotation of the container 11 causes the safety closure 10 to unscrew from the thread 17 of the container 11.

Since the container 11 is typically larger than the safety closure 10, it is generally easier to grip and rotate, particularly for elderly persons. Conversely, the container 11 is relatively difficult for infants to grip and rotate, and will further prevent the infant from obtaining access to the contents of the container 11.

Although not a preferred technique, the user may remove the safety closure 10 from the container 11 by holding the container 11 stationary while depressing the key 21 and rotating the outer closure member 12. Rotation of the outer closure member 12 causes rotation of the inner cylinder 14 to thereby unscrew the safety closure 10 from the thread 17 of the container 11. This removal technique is awkward, and is not recommended.

The safety closure 10 may be replaced onto the container 11 in a similar manner as described above by depressing the key 21 and rotating the container 11 in an opposite direction to that required for removing the safety closure 10 from the container 11.

Figure 5:
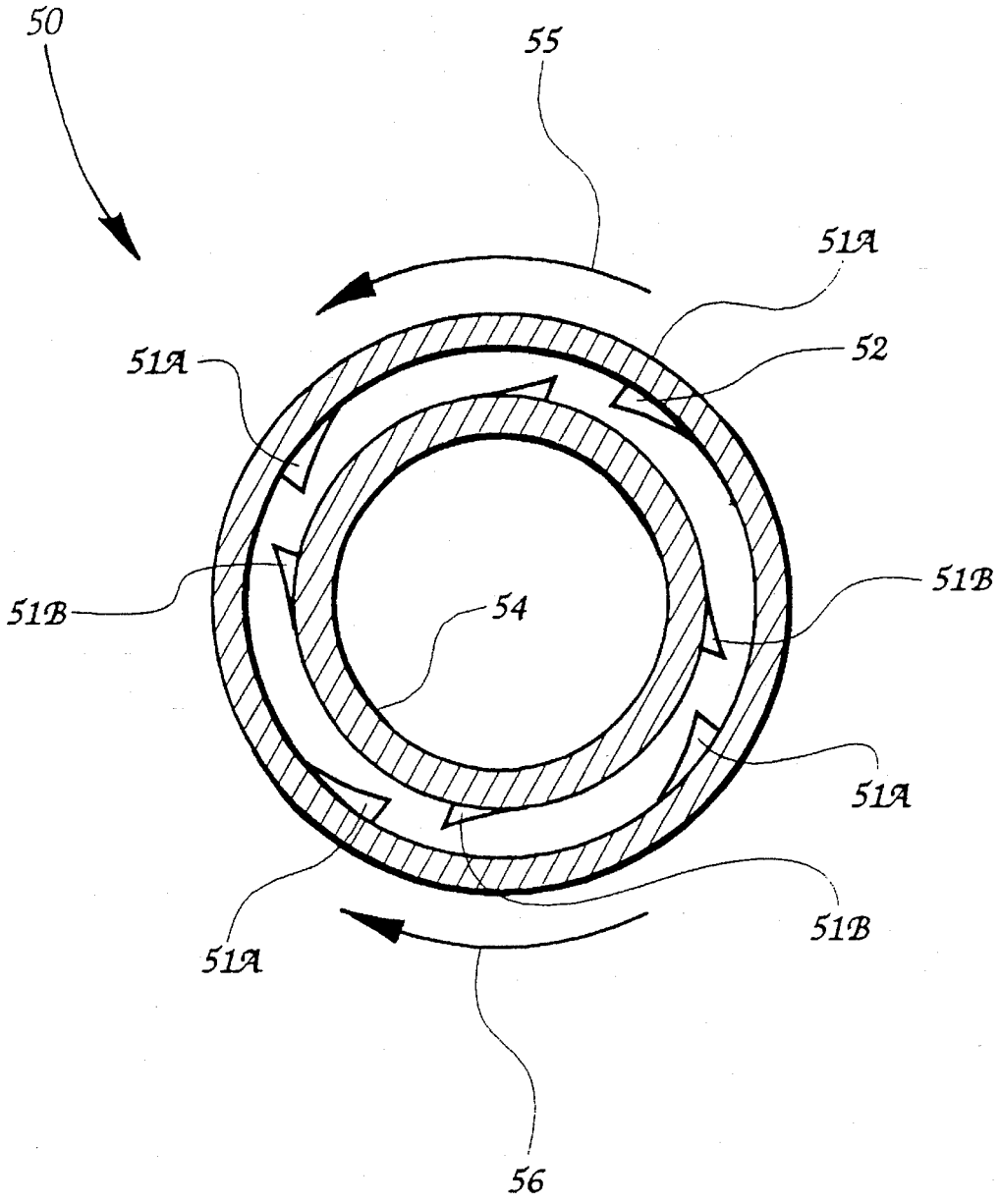
FIG. 5 is a cross-sectional view of the safety closure according to another preferred embodiment of the invention, and showing the angled teeth of the inner cylinder and outer closure member.

According to a further embodiment of the safety closure 50 illustrated in FIG. 5, angled teeth 51A and 51B are located, respectively, on the inside wall of the outer closure member 52 and the outside wall of the inner closure member 54. The teeth 51A and 51B cooperate to permit replacement of the safety closure 50 onto the container without depressing the key (not shown). Rotation of the outer closure member 52 in the direction indicated at 55 will cause the angled teeth of the inner cylinder 54 and outer closure member 52 to engage, thereby allowing the safety closure 50 to be attached and tightened onto the container. Rotation of the safety closure 50 in the opposite direction indicated at 56 will cause the angled teeth 51A and 51B to slip over each other, thereby preventing safety closure 50 from being removed from the container without depressing the key, as described above. The remaining elements of the safety closure 50 not shown in FIG. 5 are identical to that described above with reference to the safety closure 10.

A safety closure for a container is described above. Various details of the invention may be changed without departing from its scope. Furthermore, the foregoing description of the preferred embodiment of the invention is provided for the purpose of illustration only and not for the purpose of limitation-the invention being defined by the claims.

I claim:

1. A safety closure for a container, said safety closure comprising:

(a) an outer closure member having cylindrical interior walls;

(b) an inner cylinder nested within the interior walls of said outer closure member for permitting normally free rotation of said outer closure member relative to said inner cylinder;

(c) locking means for connecting the inner cylinder to a mouth of the container, and for cooperating with said outer closure member to lock the safety closure onto the container, said locking means comprising an internal screw thread formed with said inner cylinder for engaging a complementary external thread located adjacent to the mouth the container;

(d) a key permanently secured to the safety closure for unlocking said locking means, said key being manipulated by a user to prevent the normally free rotation of said outer closure member relative to said inner cylinder, and said key including a tab for being inserted into a slot formed in a top wall of said inner cylinder, whereby the safety closure is removed from the container by gripping the outer closure member, manipulating the key to locate the tab into locking engagement with the slot, and rotating the container to disengage the complementary threads of the inner cylinder and the container; and (e) biasing means located between a top wall of the inner cylinder and a top wall of the outer closure member, and engaging the key for normally urging the tab out of locking engagement with the slot.

2. A safety closure according to claim 1, wherein said key includes an outwardly-extending flange connected thereto for engaging said biasing means.

3. A safety closure according to claim 1, wherein said biasing means comprises a coil spring.

4. A safety closure according to claim 1, and including retaining means located at a bottom end of said outer closure member for holding said inner cylinder and said outer closure member in a nested condition.

5. A safety closure according to claim 4, wherein said retaining means comprises an annular flange formed at the bottom end of the outer closure member.

6. A safety closure according to claim 1, wherein said outer closure member comprises an outer cylinder.

7. A safety closure for a container, said safety closure comprising:

(a) an outer cylinder;

(b) an inner cylinder nested within said outer cylinder for permitting normally free rotation of said outer cylinder relative to said inner cylinder;

(c) retaining means located at a bottom end of said outer cylinder for holding said inner cylinder and said outer cylinder in a nested condition;

(d) locking means for connecting the inner cylinder to a mouth of the container, and for cooperating with said outer cylinder to lock the safety closure onto the container, said locking means comprising an internal screw thread formed with said inner cylinder for engaging a complementary external thread located adjacent to the mouth the container; and (e) a key permanently secured to said safety closure for unlocking said locking means, said key being manipulated by a user to prevent the normally free rotation of said outer cylinder relative to said inner cylinder, and said keg including a tab for being inserted into a slot formed in a top wall of said inner cylinder, whereby the safety closure is removed from the container by gripping the outer cylinder, manipulating the key to locate the tab into locking with the slot, and then rotating the container to disengage the complementary threads of the inner cylinder and the container; and (f) biasing means located between a top wall of the inner cylinder and a top wall of the outer cylinder, and engaging the key for normally urging the tab out of locking engagement with the slot.

8. A safety closure according to claim 7, wherein said key includes an outwardly-extending flange connected thereto for engaging said biasing means.

9. A safety closure according to claim 7, wherein said biasing means comprises a coil spring.

* * * * *